US010781499B2

(12) United States Patent
Buragino et al.

(10) Patent No.: US 10,781,499 B2
(45) Date of Patent: Sep. 22, 2020

(54) BOTTOM STIRRING TUYERE AND METHOD FOR A BASIC OXYGEN FURNACE

(71) Applicant: Air Products and Chemicals, Inc., Allentown, PA (US)

(72) Inventors: Gregory J. Buragino, Macungie, PA (US); Shailesh Pradeep Gangoli, Easton, PA (US); Anshu Gupta, Whitehall, PA (US); Anup Vasant Sane, Allentown, PA (US); Avishek Guha, Breinigsville, PA (US); Xiaoyi He, Orefield, PA (US); Michael David Buzinski, Slatington, PA (US); Kyle J. Niemkiewicz, Coopersburg, PA (US); Russell James Hewertson, Wescosville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 178 days.

(21) Appl. No.: 15/873,616

(22) Filed: Jan. 17, 2018

(65) Prior Publication Data

US 2019/0218631 A1 Jul. 18, 2019

(51) Int. Cl.
*C21C 5/48* (2006.01)
*C21C 5/34* (2006.01)
(Continued)

(52) U.S. Cl.
CPC ..... *C21C 5/48* (2013.01); *C21C 5/34* (2013.01); *C21C 5/35* (2013.01); *C21C 7/072* (2013.01)

(58) Field of Classification Search
CPC ..... C21C 5/34; C21C 5/48; C21C 7/072
See application file for complete search history.

(56) References Cited

U.S. PATENT DOCUMENTS 4,365,992 A 12/1982 Sieckman
4,395,283 A * 7/1983 Murakami ..... C21C 5/48 266/47
(Continued)

FOREIGN PATENT DOCUMENTS

CA 1153560 9/1983
CN 106167844 * 11/2016
(Continued)

OTHER PUBLICATIONS

CN 106167844 Machine Translation of Description (Year: 2016).*
(Continued)

*Primary Examiner* — Tima M. McGuthry-Banks
(74) *Attorney, Agent, or Firm* — Larry S. Zelson

(57) ABSTRACT

A method of operating a BOF bottom stir tuyere having an inner nozzle surrounded by an annular nozzle, including during a hot metal pour phase and a blow phase, flowing an inert gas through both nozzles; during a tap phase, initiating a flow of a first reactant through the inner nozzle and a flow of a second reactant through the annular nozzle, and ceasing the flow of inert gas through the nozzles, wherein the first and second reactants includes fuel and oxidant, respectively, or vice-versa, such that a flame forms as the fuel and oxidant exit the tuyere; during a slag splash phase, continuing the flows of fuel and oxidant to maintain the flame; and after ending the slag splash phase and commencement of another hot metal pour phase, initiating a flow of inert gas through both nozzles and ceasing the flows of the first and second reactants.

10 Claims, 10 Drawing Sheets

Clogging of bottom stir nozzles in a BOF bottom

(51) Int. Cl.
*C21C 5/35* (2006.01)
*C21C 7/072* (2006.01)

(56) References Cited

U.S. PATENT DOCUMENTS

| | | | | |
|---|---|---|---|---|
| 4,824,080 | A | 4/1989 | Tommaney | |
| 5,830,407 | A | 11/1998 | Cates | |
| 2017/0275714 | A1* | 9/2017 | Wallgram | C21C 7/0025 |

FOREIGN PATENT DOCUMENTS

| | | |
|---|---|---|
| FR | 2228845 | 12/1974 |
| GB | 1486539 | 9/1977 |
| WO | 2014193390 | 12/2014 |
| WO | 15200347 A1 | 12/2015 |

OTHER PUBLICATIONS

FR 2228845 Machine Translation of Description (Year: 1974).*
Farmer, L., Lach, D., Lanyi, M., Winchester, D., "Gas injection tuyeres design and experience", Steelmaking Conference Proceedings, p. 487495 (1989).
Guoguang, Zhao & Husken, Rainer & Cappel, Jurgen. (2012) Expereince with long BOF campaign life and TBM bottom stirring technology. Stahl und Eisen. 132. 61-78.
Barker, K. J. Chapter 8 "Oxygen Steelmaking Furnace Mechanical Description and Maintenance Considerations" and Chapter 9 "Oxygen Steelmaking Processes". The AISE Steel Foundation, Pittsburgh, PA, p. 405, Section 9.5.1.
K. H. Lee, et al. "Effect of secondary swirl flow on the supersonic and coaxial free jet". In: Jiang Z. (eds) Shock Waves. Springer, Berlin, Heidelbert.

* cited by examiner

Clogging of bottom stir nozzles in a BOF bottom

Nitrogen flows maintained during slag splashing process to reduce potential for clogging Bridging of slag over bottom stir nozzles Bottom build-up condition Bottom stir nozzles used to generate a flame during the slag splash operation

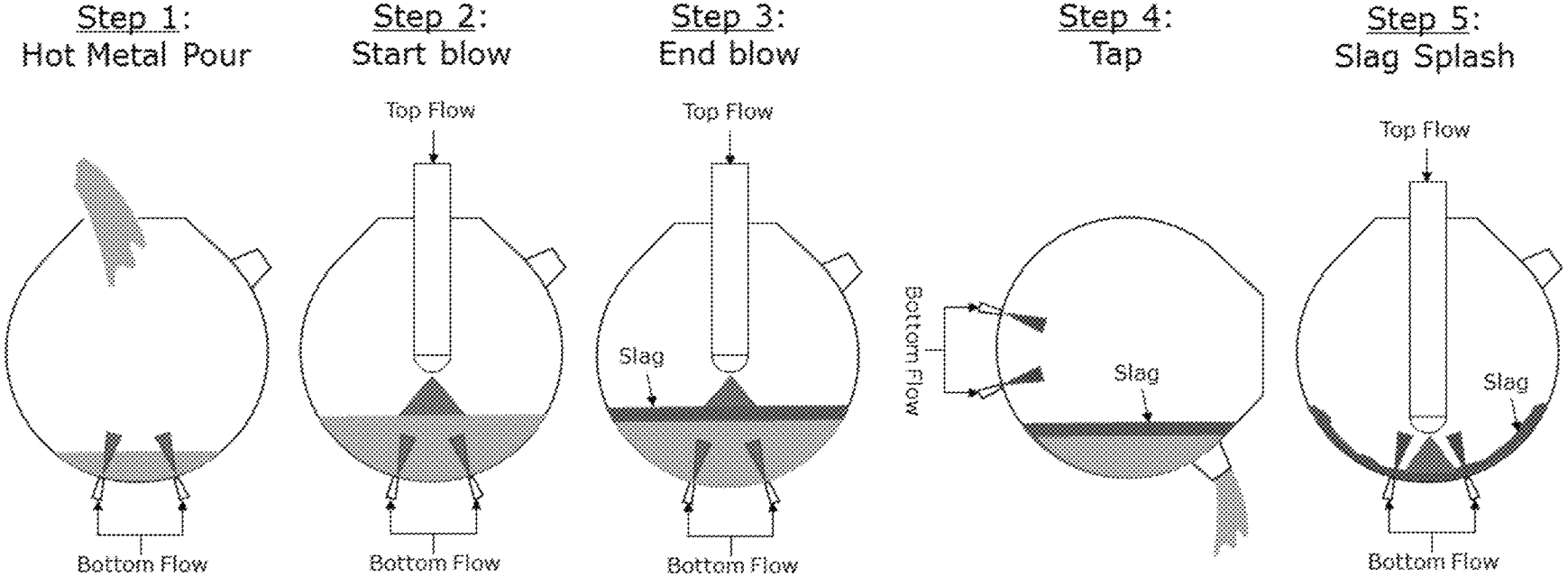
| | Gases | Step 1 | Step 2 | Step 3 | Step 4 | Step 5 |
|---|---|---|---|---|---|---|
| Top Flow | Oxygen | No | Yes | Yes | No | No |
| | Nitrogen | No | No | No | No | Yes |
| Bottom Flow | Argon | No | No | Yes | Yes/No | Yes/No |
| | Nitrogen | Yes | Yes | No | Yes/No | Yes/No |
| | Fuel | No | No | No | Yes | Yes |
| | Oxygen | No | No | No | Yes | Yes |
FIG. 7 Modified BOF bottom stirring method of the present invention

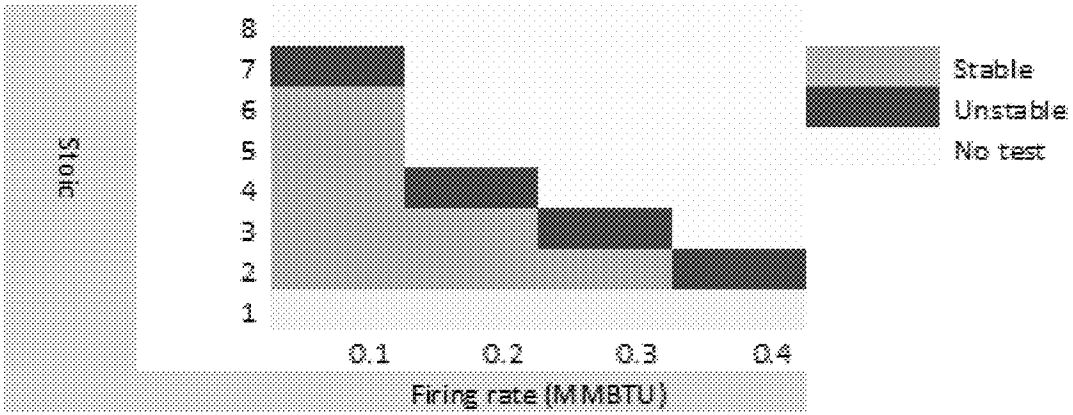
FIG. 8 Operation of stirring converging-diverging nozzles without cavity
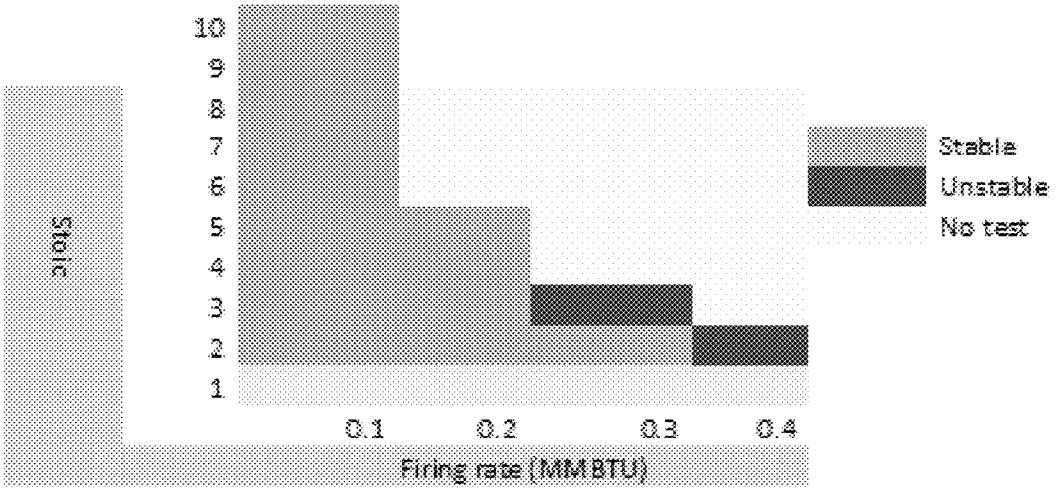
FIG. 9 Operation of stirring converging-diverging nozzles with cavity

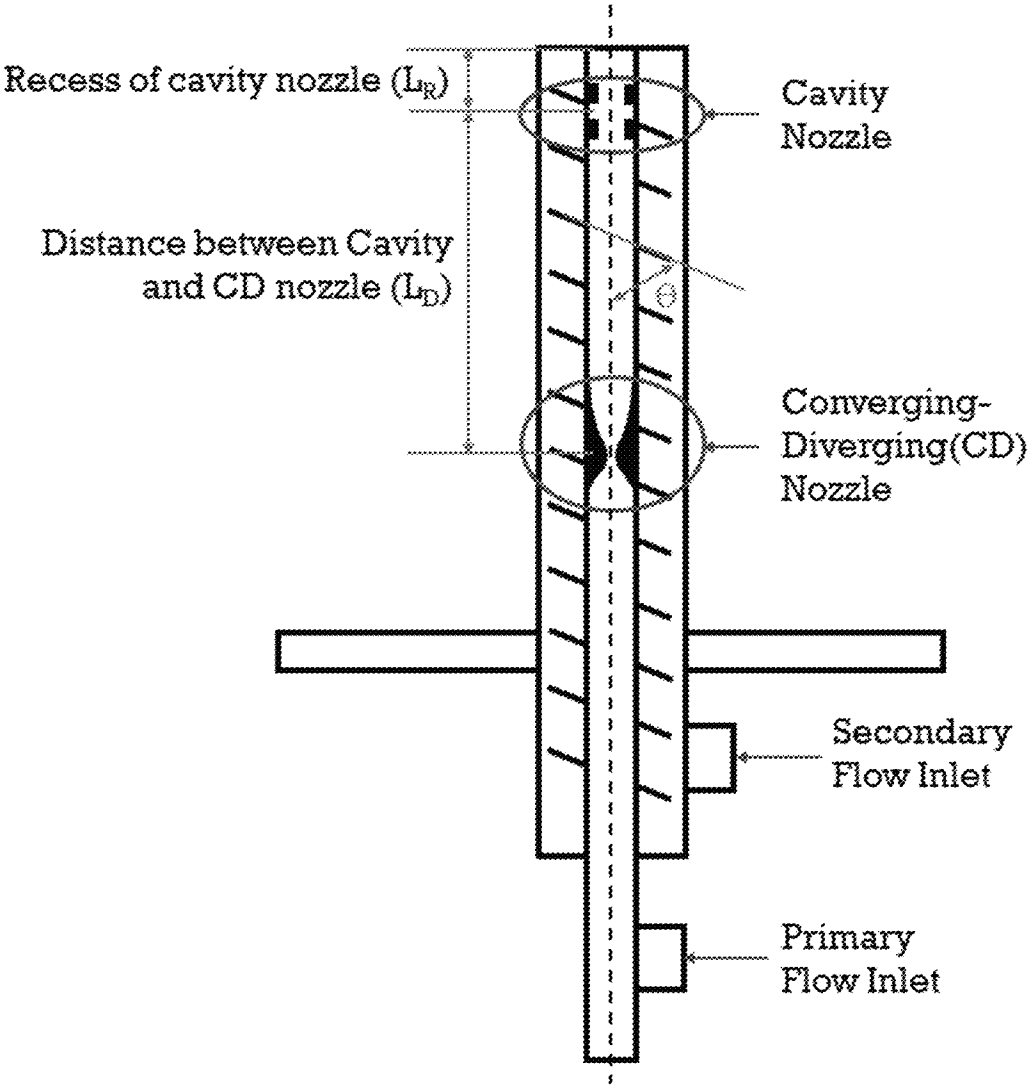
FIG. 10 Bottom stir tuyere

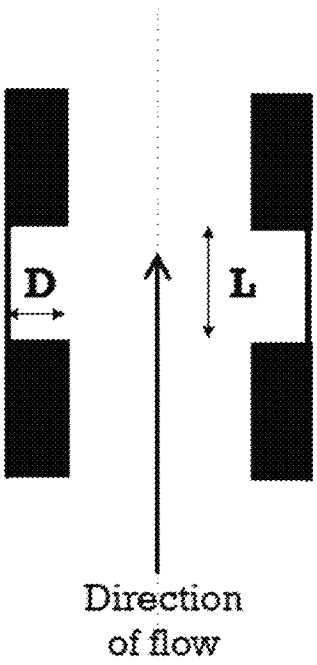
FIG. 11 Detail of cavity nozzle

BOTTOM STIRRING TUYERE AND METHOD FOR A BASIC OXYGEN FURNACE

BACKGROUND

This application relates to a tuyere and a method for improving the operability using inert gas to bottom stir a basic oxygen furnace (BOF).

BOF's have been commonly used since the mid-20$^{th}$ century to convert pig iron into steel, primarily by the use of oxygen to remove carbon and impurities. The BOF was an improvement over the earlier Bessemer process that blew air into the pig iron to accomplish the conversion. In a BOF, blowing oxygen through molten pig iron lowers the carbon content of the metal and changes it into low-carbon steel. The process also uses fluxes of burnt lime or dolomite, which are chemical bases, to promote the removal of impurities and protect the lining of the vessel.

In the BOF, oxygen is blown at supersonic velocity into the bath using a top lance, which causes an exothermic reaction of oxygen and carbon, thereby generating heat and removing carbon. The ingredients, including oxygen, are modeled and the precise amount of oxygen is blown so that the target chemistry and temperature are reached within about 20 minutes.

The metallurgy and efficiency of the oxygen blowing are improved by bottom stirring (which may also be called combined blowing); basically, stirring the molten metal by introduction of gas from below improves the kinetics and makes the temperature more homogeneous, enabling better control over the carbon-oxygen ratio and the removal of phosphorous.

It is relatively common outside of the US to use an inert gas, such as argon and/or nitrogen, for bottom stirring. Benefits of BOF bottom stirring include potentially higher yield and increased energy efficiency. However, BOF bottom stirring is not common in the US because of the poor reliability and difficulty maintaining the bottom stirring nozzles due to slag splashing practices commonly used in the US. Slag splashing helps improve refractory and vessel lifetime, but causes blockage of existing bottom stirring nozzles.

Even in non-US facilities that employ BOF bottom stirring, the lifetime of the existing bottom stirring nozzles, before they become clogged or occluded, is often significantly less than the length of a furnace campaign. For example, it is not uncommon for a BOF campaign to run ten thousand, fifteen thousand, or even twenty thousand heats, but the bottom stirring nozzles rarely last more than three to five thousand heats before they are no longer usable. Therefore, for at least half, and in some cases as much as 85% of the furnace campaign, bottom stirring is not available.

Historically, other operations introducing gases from beneath the molten metal have been used from time to time in steel making. For example, in the 1970's processes were developed to use oxygen for decarburization in steel making by injection of natural gas (or other gases used as coolants), along with the oxygen, through tuyeres having concentric nozzles (usually with oxygen flowing through the inner central nozzle and fuel flow through the outer annular nozzle). For example, a 100% bottom-blown (OBM) process uses natural gas to shroud the tuyeres that inject oxygen into the process. Some variants of this process have also been used, such as Q-BOP (basic oxygen process), which also injects powdered lime through the tuyeres. These method are described, for example, in Chapter 8: Oxygen Steelmaking Furnace Mechanical Description and Maintenance Considerations; Chapter 9: Oxygen Steelmaking Processes; Fruehan, R. J., The Making, Shaping and Treating of Steel: Steelmaking and Refining Volume, 11th Edition, AIST, 1998, ISBN: 0930767020; and at https://mme.iitm.ac.in/shukla/BOF%20steelmaking%20process.pdf. These processes usually end up with higher bottom wear and need bottom replacement midway through furnace campaigns.

In other instances, the inert gas flows are maintained at high flow rates all the time, even when bottom stirring is not needed to combat the potential for clogging, which is inefficient and uses excessive amounts of inert gases. See, for example, Mills, Kenneth C., et al. "A review of slag splashing." ISIJ international 45.5 (2005): 619-633); and https://www.jstage.jst.go.jp/article/isijinternational/45/5/45_5_619/_pdf.

In yet other instances, slag chemical compositions have been modified in combination with 50% higher flows used for stirring in the event that a clog is detected. See, for example, Guoguang, Zhao & Hüsken, Rainer & Cappel, Jürgen. (2012), Experience with long BOF campaign life and TBM bottom stirring technology, Stahl and Eisen, 132. 61-78 (which improved tuyere life to 8,000-10,000 cycles). However, these modifications require a great deal of process knowledge and control i.e. addition of MgO pellets and managing the CaO/SiO2 ratio depending on the [C]—[O] levels in the slag.

SUMMARY

Aspect 1. A method of operating a bottom stir tuyere in a basic oxygen furnace for steel making, wherein the bottom stir tuyere has a concentric nozzle arrangement with an inner nozzle surrounded by an annular nozzle, the method comprising: (a) during a hot metal pour phase, flowing an inert gas through both nozzles of the bottom stir tuyere; (b) during a blow phase, continuing to flow the inert gas through both nozzles of the bottom stir tuyere; (c) during a tap phase, initiating a flow of a first reactant and ceasing the flow of inert gas through the inner nozzle of the tuyere, and initiating a flow of a second reactant and ceasing the flow of inert gas through the annular nozzle of the tuyere, wherein the first reactant includes one of fuel and oxidant and the second reactant includes the other of fuel and oxidant, such that a flame forms as the fuel and oxidant exit the tuyere; (d) during a slag splash phase, continuing the flows of fuel and oxidant to maintain the flame; and (e) after ending the slag splash phase and commencement of another hot metal pour phase, initiating a flow of inert gas through both nozzles of the bottom stir tuyere and ceasing the flows of the first and second reactants.

Aspect 2. The method of Aspect 1, wherein the inert gas flowed through both nozzles in step (a) comprises nitrogen, argon, carbon-dioxide, or combinations thereof.

Aspect 3. The method of Aspect 1 or 2, wherein in steps (c) and (d), oxidant is flowed through the inner nozzle as the first reactant and fuel is flowed through the annular nozzle as the second reactant.

Aspect 4. The method of any one of Aspects 1 to 3, wherein the first reactant has a velocity $V_P$ and the second reactant has an axial velocity $V_S$, and wherein the ratio of the first reactant velocity to the second reactant axial velocity is $2 \leq V_P/V_S \leq 30$.

Aspect 5. The method of any one of Aspects 1 to 4, further comprising, in step (d), additionally flowing a diluent gas in conjunction with the oxidant and adjusting the relative proportion of diluent gas to oxidant, thereby adjusting an energy release profile of the burner.

Aspect 6. The method of Aspect 5, further comprising, in step (d), additionally flowing a diluent gas in conjunction with the fuel and adjusting the relative proportion of diluent gas to fuel.

Aspect 7. The method of any one of Aspects 1 to 6, further comprising causing one or both of the first reactant and the inert gas to exit the central nozzle at a velocity attaining from Mach 0.8 to Mach 1.5.

Aspect 8. The method of any one of Aspects 1 to 7, further comprising imparting swirl to the second reactant and the inert gas exiting the annular nozzle.

Aspect 9. The method of any one of Aspects 1 to 8, further comprising sensing at least one of a pressure and a temperature of the tuyere to detect a deviation from normal operating conditions, and taking corrective action in response to a detected deviation from normal operating conditions, wherein the corrective action includes one or more of flowing a high volume of inert gas through both nozzles of the tuyere, prescribing bottom washing of the furnace, and shutting down furnace operation.

Aspect 10. A bottom stir tuyere for use in a basic oxygen furnace for steel making, comprising: an inner nozzle configured and arranged to flow, in the alternate, either a first reactant or an inert gas; an annular nozzle surrounding the inner nozzle and configured and arranged to flow, in the alternate, either a second reactant or an inert gas; and a controller programmed to cause an inert gas to flow through both of the nozzles during a hot pour phase and a blow phase of the furnace operation, and to cause a first reactant to flow through the inner nozzle and a second reactant to flow through the annular passage during a tap phase and a slag splash phase of the furnace operation; wherein the first reactant includes one of fuel and oxidant and the second reactant includes the other of fuel and oxidant.

Aspect 11. The tuyere of Aspect 10, wherein the inner nozzle is a converging-diverging nozzle sized to cause the first reactant to exit the inner nozzle at a velocity attaining from Mach 0.8 to Mach 1.5.

Aspect 12. The tuyere of Aspect 11, wherein the inner nozzle further includes a cavity downstream of the converging-diverging nozzle, the cavity having a length L, a depth D, and a length to depth ratio of $1 \leq L/D \leq 10$.

Aspect 13. The tuyere of Aspect 12, wherein the cavity is downstream of the converging nozzle by a distance $L_D$ measured from the upstream edge of the cavity to the throat of the converging-diverging nozzle, wherein $0 \leq L_D/L \leq 3$.

Aspect 14. The tuyere of Aspect 12, wherein the cavity is recessed from an exit end of the inner nozzle by a distance $L_R$ measured from the downstream edge of the cavity, wherein $0 \leq L_R/L \leq 20$.

Aspect 15. The tuyere of Aspect 10, wherein the inner nozzle includes a cavity having a length L, a depth D, and a length to depth ratio of $1 \leq L/D \leq 10$, wherein the cavity is downstream of the converging nozzle by a distance $L_D$ measured from the upstream edge of the cavity to the throat of the converging-diverging nozzle, wherein $0 < L_D/L \leq 3$, and wherein the cavity is recessed from an exit end of the inner nozzle by a distance $L_R$ measured from the downstream edge of the cavity, wherein $0 < L_R/L \leq 20$.

Aspect 16. The tuyere of any one of Aspects 10 to 15, wherein the annular nozzle includes swirl vanes having an acute angle from 10° to 60° with respect to the axial flow direction.

Aspect 17. The tuyere of any one of Aspects 10 to 16, further comprising a pressure sensor to detect a pressure upstream of the inner nozzle, wherein the controller is further programmed to detect possible occlusion or erosion of the tuyere based on the detected pressure.

Aspect 18. The tuyere of any one of Aspects 10 to 17, further comprising a temperature sensor to detect a tuyere temperature, wherein the controller is further programmed to detect possible erosion of the tuyere based on the detected temperature.

Aspect 19. A method of operating a bottom stir tuyere in a basic oxygen furnace for steel making, wherein the bottom stir tuyere has a concentric nozzle arrangement with an inner nozzle surrounded by an annular nozzle, the method comprising: (a) during a hot metal pour phase, flowing an inert gas through both nozzles of the bottom stir tuyere; (b) during a blow phase, continuing to flow the inert gas through both nozzles of the bottom stir tuyere; (c) during a tap phase, initiating an electric discharge between the inner nozzle and the annular nozzle while continuing the flow of inert gas through the inner nozzle and annular nozzles, thereby causing a plasma to discharge from the tuyere; (d) during a slag splash phase, continuing the electric discharge to maintain the plasma discharge from the tuyere; and (e) after ending the slag splash phase and commencement of another hot metal pour phase, continuing the flow of inert gas through inner and annular nozzles of the bottom stir tuyere while ceasing the electric discharge.

The various aspects of the system and method disclosed herein can be used alone or in combinations with each other.

BRIEF DESCRIPTION OF THE DRAWINGS

FIG. 7 is a schematic showing a sequence of operation of an embodiment of a modified BOF steel making process using bottom stirring and a process as described herein for inhibiting bottom stir tuyeres from clogging during slag splashing.

FIG. 8 is a graph showing the stability of a tuyere having an inner nozzle without a cavity as described herein, over a range of firing rates and stoichiometries.

FIG. 9 is a graph showing the stability of a tuyere having an inner nozzle with a cavity as described herein, over a range of firing rates and stoichiometries.

FIG. 10 is a schematic sectional view of a bottom stir tuyere for use in bottom stirring operations and during slag splashing.

FIG. 11 is a detailed partial sectional view of the cavity nozzle of the bottom stir tuyere of FIG. 10.

DETAILED DESCRIPTION

An inventive process as described herein, combined with the use of inventive bottom stir tuyeres as described herein, enables the use of bottom stirring in a BOF with improved reliability, timely detection/mitigation of problems, and easier maintenance of bottom stirring tuyeres, in an operation that also practices slag splashing. These improvements will also enable BOF bottom stirring operations that do not currently utilize slag splashing to begin using slag splashing and obtaining the benefits thereof.

As used herein, oxidant shall mean enriched air or oxygen having a molecular oxygen concentration of at least 23%, preferably at least 70%, and more preferably at least 90%. As used herein, inert gas shall mean nitrogen, argon, carbon-dioxide, other similar inert gases, and combinations thereof. As used herein, fuel shall mean a gaseous fuel, which may include but is not limited to natural gas.

To allow bottom stirring to be used in a BOF that also employs slag splashing, the present inventors have determined that it is necessary to minimize the probability of clogging the bottom stir tuyeres and to have a tuyere nozzle flow structure that achieves the desired stirring condition both with a new BOF and under a bottom buildup condition resulting from successive slag splashing operations.

Figure 1:
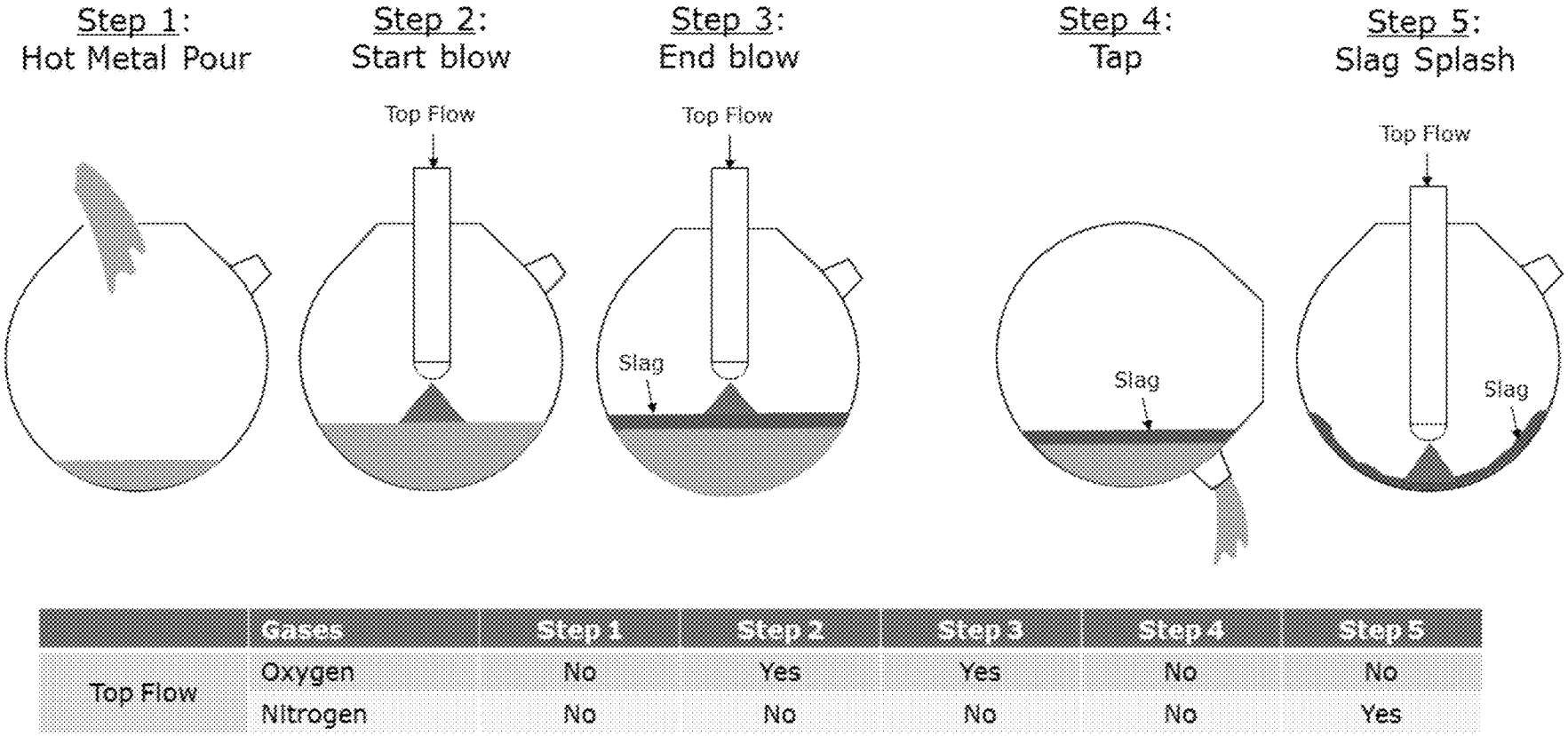
FIG. 1 PRIOR ART
FIG. 1 is a schematic showing a sequence of operation of a baseline BOF steel making process without the use of bottom stirring.

A typical BOF steel making process has four phases, shown by way of five steps in FIG. 1: a pour phase (Step 1), a blow phase (started by Step 2 and ended by Step 3), a tap phase (Step 4), and a slag splash phase (Step 5). The cycle repeats, so after Step 5, the process recycles to Step 1.

In Step 1 (Hot Metal Pour), hot metal (pig iron) is loaded or poured into the furnace vessel through a top opening, to achieve a desired fill level.

In Step 2 (Start Blow), a flow of oxygen is injected through a lance inserted through the top opening of the furnace; during this process, slag is formed on the top surface of the molten metal. In Step 3 (End Blow), the flow of oxygen is stopped and the lance is removed from the top opening.

In Step 4 (Tap), the furnace is tilted and the molten metal is poured out through a tap on the side of the furnace, while the slag is left behind in the furnace.

Figure 2:
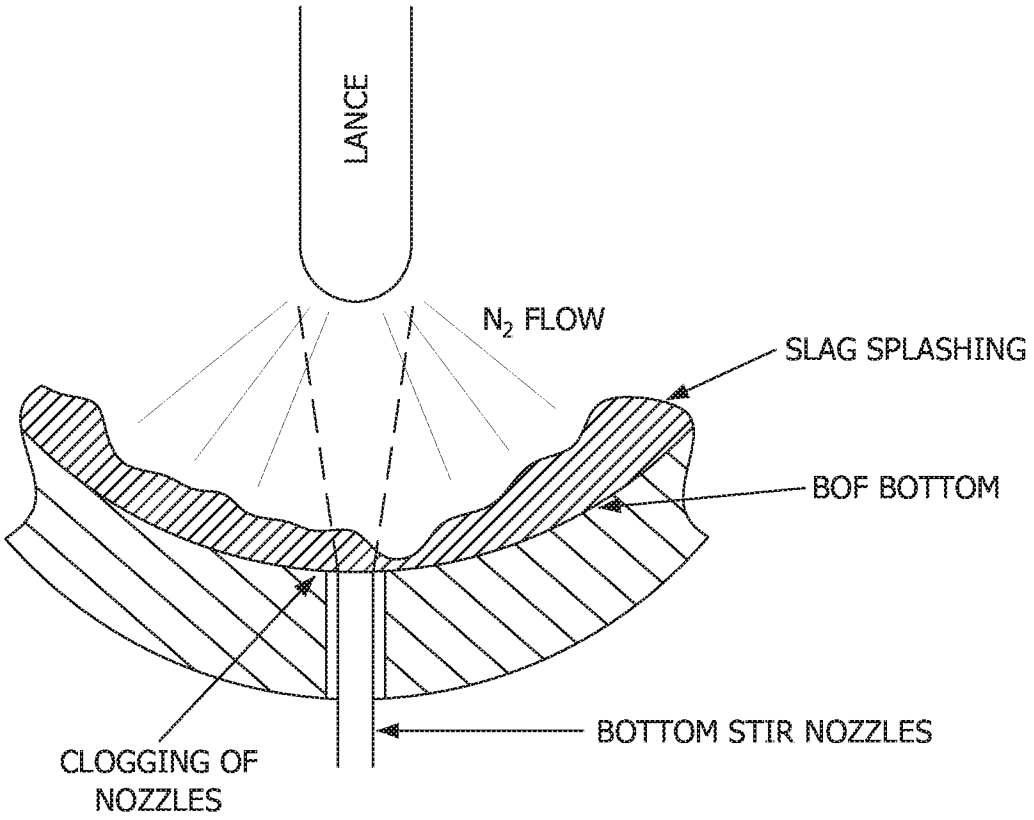
FIG. 2 is a schematic sectional view showing clogging of existing bottom stir nozzles in a BOF bottom in a process not using the tuyeres and process modifications described herein.

In Step 5 (Slag Splash), the furnace is returned to an upright position and a flow of nitrogen is injected through a lance inserted through the top opening of the furnace. The nitrogen is flowed in large quantities (e.g., 20,000 SCFM) at supersonic velocities into the BOF, which causes the molten slag to splash all over the walls of the furnace vessel. This results in coating of the BOF vessel with a layer of protective slag, which in part replaces some of the vessel refractory that is consumed or eroded away during the BOF process. Slag splashing, however, if done in a vessel with bottom stir nozzles, often results in partial or complete clogging of the bottom stir nozzles located at the bottom of the vessel. This clogging, as shown in FIG. 2, essentially prevents or restricts further flow of gases through the bottom stir nozzles into the BOF, and eventually, after multiple slag splashing, results in losing the ability to bottom stir at all.

Figure 3:
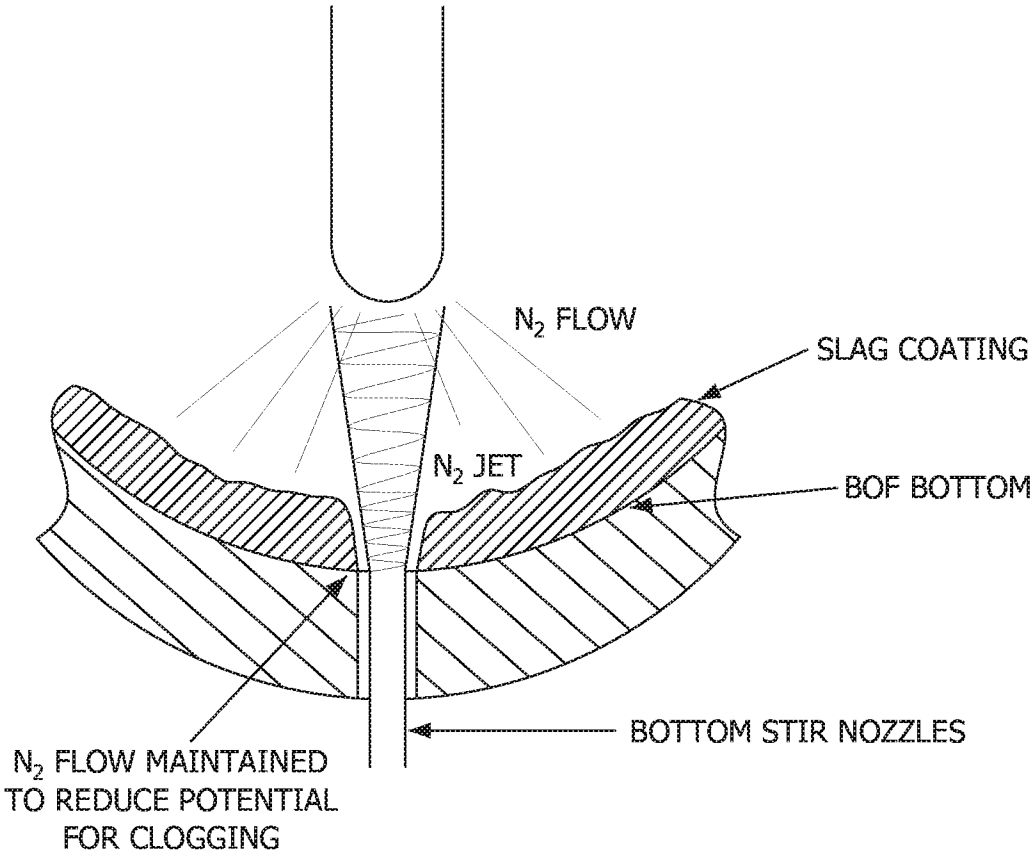
FIG. 3 is a schematic sectional view showing an embodiment of a process in which inert gas flow is used during slag splashing in attempt to reduce the likelihood of bottom stir nozzle clogging.
Figure 4:
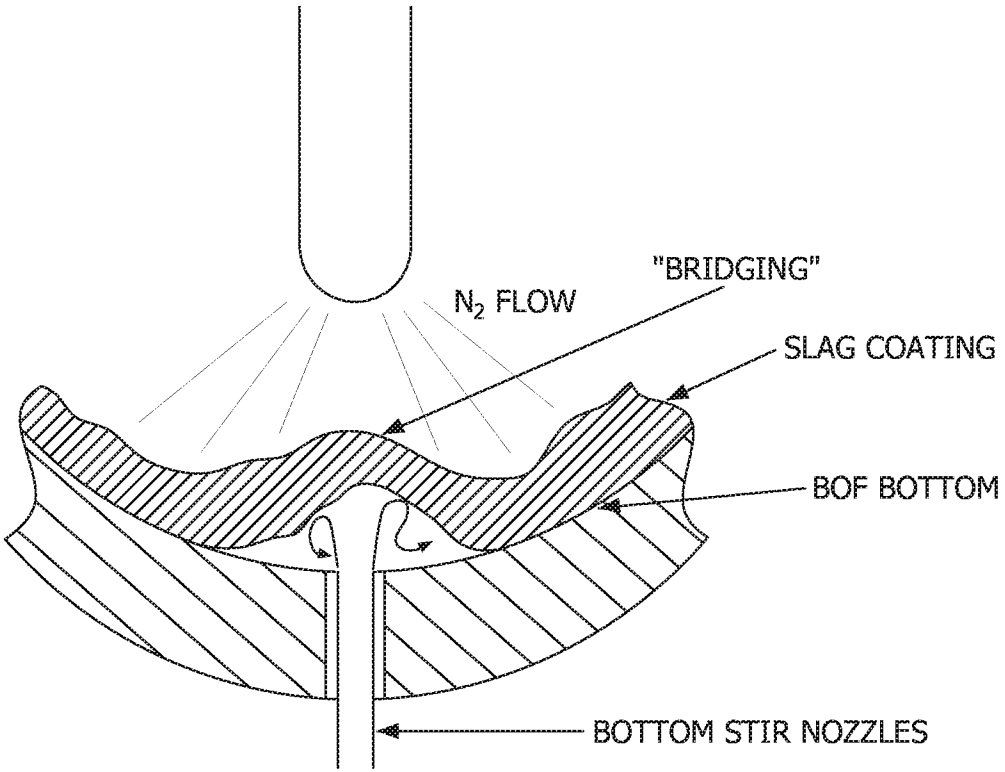
FIG. 4 is a schematic sectional view showing bridging of slag over a bottom stir nozzle despite a flow of inert gas during slag splashing as in FIG. 3.
Figure 5:
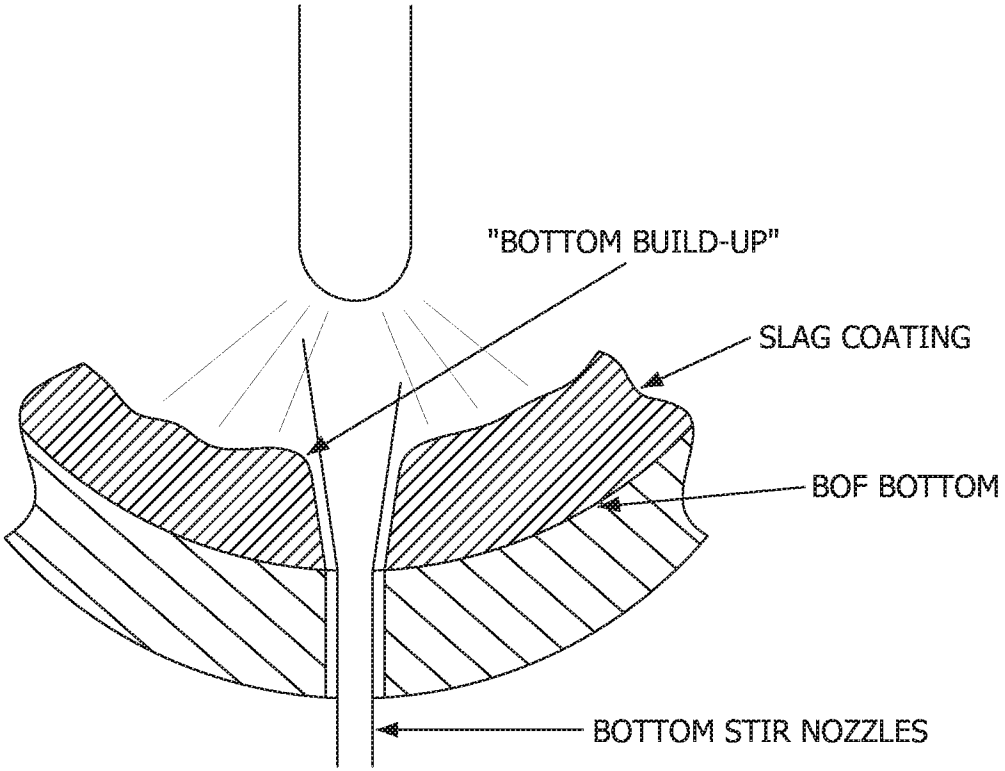
FIG. 5 is a schematic sectional view showing a slag buildup condition in a BOF bottom around a bottom stir nozzle.

Some previous attempts have been made to keep existing bottom stir nozzles open by flowing nitrogen through the bottom stir nozzles during slag splashing, under the notion that the nitrogen flow would provide resistance to the on-coming splash of slag (see FIG. 3). However, this method has not reliably been able to keep the bottom stir nozzles from clogging. Another challenge experienced during these attempts was bridging (see FIG. 4), in which the bottom stir nozzle itself stays open but a bridge of slag forms about the nozzle, effectively nullifying any stirring effect that could be obtained by flow exiting the nozzle. Bridging results in continuation and wastage of inert gas flows into the space between slag and refractory walls before exiting the BOF vessel instead of participating in stirring. A further challenge experienced during these attempts was bottom build-up (see FIG. 5), in which an extended channel of slag forms downstream of the bottom stir nozzle, thereby causing deceleration of the inert gas jet and decreased stirring effectiveness.

Disclosed herein are a self-sustaining bottom stir tuyere and a bottom stirring method which, combined, overcome these previous difficulties, as well as a control system for use with such a tuyere and method. The self-sustaining tuyere is basically a concentric tube design, where one fluid is flowed through the inner central nozzle while another fluid is flowed through the outer annular nozzle. In the description that follows, the inner central nozzle may sometimes be referred to as the primary nozzle, and the outer annular nozzle may sometimes be referred to as the secondary nozzle.

In one embodiment, the inner central passage is configured to selectively flow either fuel or an inert gas and the outer annular passage is configured to selectively flow either oxygen or an inert gas, depending on the phase of operation of the BOF. In an alternate embodiment, the inner central passage is configured to selectively flow either oxidant or an inert gas and the outer annular passage is configured to selectively flow either fuel or an inert gas, again depending on the phase of operation of the BOF.

More specifically, each stirring tuyere is made up of coaxial nozzles (pipe-in-pipe configuration), for example as shown in FIG. 10. The tuyere is installed in the BOF so that it has an exit end or hot tip facing into the furnace. During operation, fuel and oxygen, or alternatively an inert gas such as nitrogen, argon, or carbon-dioxide, are interchangeably introduced into both the inside and outside nozzles, depending on the phase of operation in the BOF.

The main role of the primary nozzle is to provide flow regimes that are effective for stirring e.g., jetting flows to prevent back attack. The main role of the secondary nozzle is to provide protection to the primary nozzle and enhance interaction with the primary nozzle flows, particular to help stabilize a flame during the slag splashing phase, by use of special features e.g., swirling flows.

The primary nozzle may have one of several configurations. For example, the primary nozzle may be a straight nozzle, a converging-diverging nozzle (to create supersonic flows), a cavity nozzle, or a combination of a converging-diverging nozzle with cavity.

When the primary nozzle is or includes a converging-diverging nozzle, the nozzle should be preferably sized for Mach>1.25 to ensure jetting flow (see, e.g., Farmer, L., Lach, D., Lanyi, M., Winchester, D., "Gas injection tuyeres design and experience", Steelmaking Conference Proceedings, Pg. 487-495 (1989)). Jetting flow helps to: (a) prevent back attack on the bottom refractory, and (b) achieve more effective stirring. Jetting flow is achieved when there is sufficient gas pressure to develop an underexpanded jet (when pressure of the gas exiting the tuyeres is greater than the pressure or static head of the surrounding fluid) such that a continuous flow of gas (no bubble formation) is generated to prevent periodic backflow of liquid (metal/slag) into the tuyere.

When the primary nozzle includes a cavity (for example as in PCT/US2015/37224), the cavity should be sized to have a length to diameter (L/D) ratio of 1 to 10, preferably from 1.5 to 2.5. A detail of a cavity nozzle with these dimensions is shown in FIG. 11. The preferred L/D ratio range helps to: (a) increase the coherence and penetration of the jetting flow for more effective stirring, and (b) improve the stability of the flame over a wide range of firing rates and stoichiometry. FIGS. 8 and 9 show the improvement in flame stability for a nozzle with cavity (FIG. 9) versus a nozzle without a cavity (FIG. 8), wherein the nozzle is designed to fire at 0.2 MMBtu/hr. Additionally, the cavity nozzle may be recessed up to a length $L_R$ from the hot tip of the primary nozzles to improve the lifetime and maintain the performance of the primary nozzle, wherein $L_R$ is measured from the downstream edge of the cavity. Preferably $L_R/L$ is from greater than 0 to about 20, and more preferably from 0.1 to 5.

When used together, the distance between the converging-diverging nozzle and the cavity can be up to a length $L_D$, where $L_D/L$ is from greater than 0 to 3, and preferably from 0.1 to 1, and wherein $L_D$ is measured from the upstream edge of the cavity to the throat of the converging-diverging nozzle.

The secondary nozzle should preferably have swirl vanes to induce a swirling flow that enhances the interaction with primary flow and assists with stabilization of the flame during Steps 4 and 5. The acute angle (θ) of vanes relative to the tuyeres axis may be from 0 degrees and 90 degrees (see FIG. 10), and preferably from 10 degrees to 60 degrees, and more preferably from 15 degrees to 45 degrees.

The velocity ratio ($V_P/V_S$) between the primary nozzle flow ($V_P$) and the secondary nozzle flow ($V_S$) can be from 2 to 30, where $V_S$ is the axial component of the secondary flow velocity.

Figure 6:
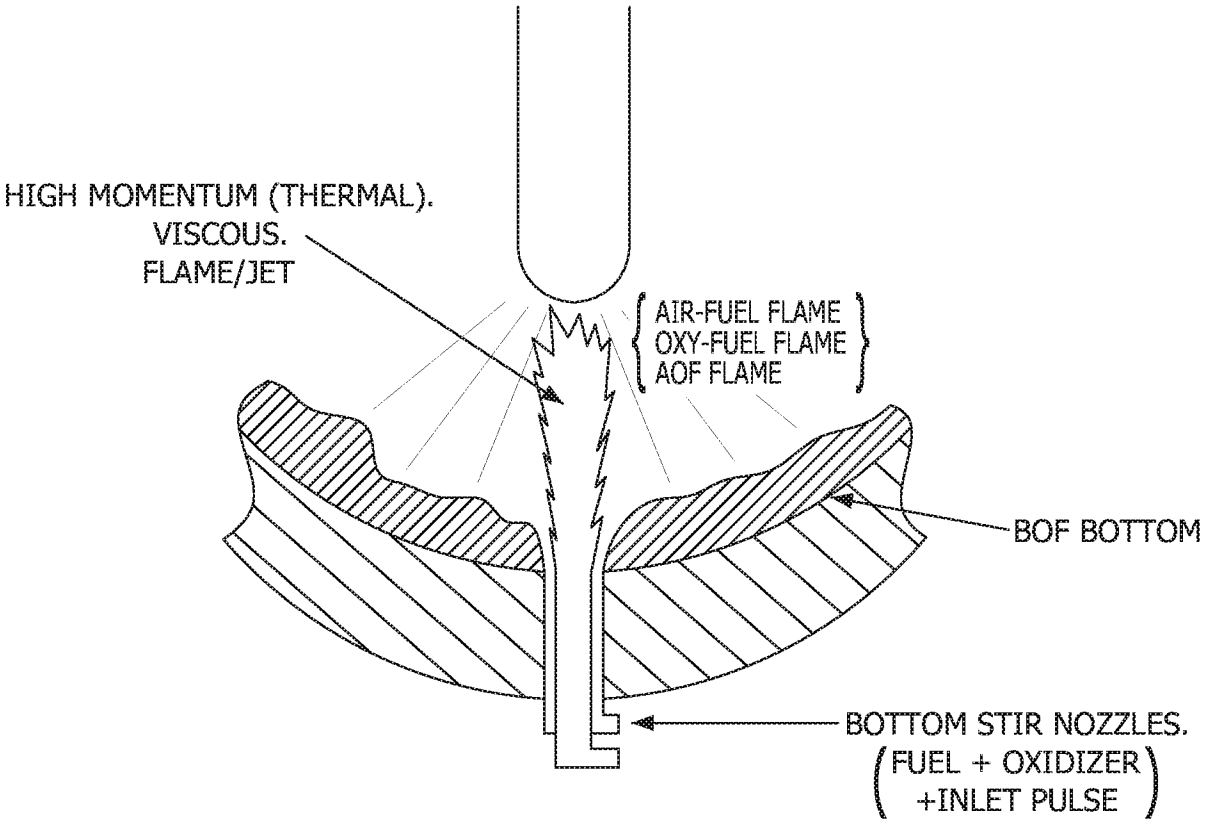
FIG. 6 is schematic sectional view showing an embodiment of a process in which a high momentum viscous flame or thermal jet is exhausted form a bottom stir tuyere during slag splashing to reduce the likelihood of bottom stir tuyere clogging, using an embodiment of a bottom stir tuyere as in FIG. 10.

The self-sustaining tuyeres function in two modes of operation. During the blow phase of the BOF, the tuyeres function in a Bottom Stirring (BS) mode, in which inert gases flow through the nozzles at a rate sufficient to achieve effective stirring of the molten steel in the furnace. During the slag splash phase of the BOF the tuyeres function in a Slag Splashing (SS) mode, in which a combination of fuel and oxidant, and optionally inert gases flow through the tuyere (see FIG. 6).

More specifically, FIG. 7 illustrates the operation strategy of the self-sustaining bottom stir tuyeres, and in particular, illustrates how the proposed process differs from the standard process of BOF steelmaking. In Steps 1 to 3 (during the pour phase and the blow phase), the bottom stir tuyeres operate in the bottom stirring mode, while in Steps 4 to 5 (during the tap phase and the slag splash phase), the bottom stir tuyeres operate in the slag splashing mode.

In Step 1 (Hot Metal Pour), a flow of inert gas through both nozzle passages is initiated (or continued) prior to starting the pour of hot metal into the furnace, and the flow of inert gas is maintained through the pour. This prevents the bottom stir nozzle from overheating and/or clogging. In Step 2 (Start Blow), the flow of inert gas through both nozzle passages is continued, at the same or a different flow rate, to achieve stirring of the molten metal. In Step 3 (End Blow), the flow of inert gases is continued as during Step 2. During steps 1 through 3, the most effective results are achieved by flowing inert gases such as argon, nitrogen, carbon-dioxide, or combinations thereof through both the primary nozzle and the secondary nozzle of the tuyere.

In Step 4 (Tap), when the BOF vessel is tilted to pour the metal out, the flow through the nozzle passages is switched over to fuel through one passage and oxidant through the other passage, to produce a flame (the furnace walls are sufficiently hot to cause auto-ignition of a fuel-oxidant mixture exiting the nozzles). Combustion, in the form of a flame exiting each bottom stir tuyere, must be commenced prior to the start of the slag splashing operation. In Step 5 (Slag Splash), the flames prevent the tuyeres from clogging, and also prevent the formation of bridges. Thus, during Steps 4 and 5, fuel and oxidant are introduced through the nozzles. It is preferable to introduce oxidant through the primary nozzle and fuel through the secondary nozzle. However, the vice-versa arrangement may also be used. Additionally, a diluent gas such as nitrogen or air may be added to the flow through either or both the primary nozzle and the secondary nozzle to help manage the location of heat release (i.e., how far away from the nozzles the bulk of combustion occurs) and the volumes or momentum required to provide the desired flow profile (i.e., adding nitrogen or air increases the volumetric flow rate or momentum). This can be accomplished by adjusting the ratio or relative proportion of diluent gas to oxidant and/or fuel.

Alternatively, an electrical discharge (plasma arc) may be used to replace fuel and oxidizer as the source of energy to prevent nozzle clogging during the tap and slag splashing phases. In practice, an electric discharge would be created between the inner nozzle and the annular nozzle of the tuyere while the flow of inert gas is maintained during those phases operation. Further alternatively, a preheated (preferably to a temperature greater than 2500° F.) gas stream may be utilized as a source of energy.

The slag splashing process involves formation of slag droplets (by impingement of a high momentum supersonic jet of nitrogen) followed by rapid convective cooling of the slag droplets (by the same nitrogen flow swirling through the vessel). This process causes an increase in the viscosity and surface tension of the slag, followed by fairly rapid solidification, which thus results in bridging and/or clogging that an inert gas flow alone is not able to prevent.

In contrast, the presently described tuyere and method can prevent bridging and clogging of the bottom stir tuyeres during the slag splashing process. The primary mechanism to prevent of clogging is by using heat (i.e., the heat of combustion of fuel and oxidant) to simultaneously: (a) lower the viscosity and surface tension of the slag that is local to and surrounds the bottom stir nozzles, and (2) increase viscosity of the gas jets exiting the tuyeres and thermally enhance the momentum of flows through the nozzles.

The bottom stir tuyere combined with the method as described herein, achieves results that are not obtainable using prior art bottom stir nozzles and methods. First, thermally managing the viscosity and surface tension of slag at a local level near the tuyeres is more easily accomplished than attempting to alter the chemical composition of all the slag (which may also impact the chemistry of the steel itself). Second, thermally enhancing the momentum and viscosity of gas jets provides significant nozzle clearing power as compared with only increasing the flow rate of inert gases. Third, utilizing fuel and oxygen only during a specific part of the cycle (i.e., Steps 4 and 5 in FIG. 7) to minimize the potential for clogging, is more efficient and less costly than using oxygen and fuel (as a coolant) continuously throughout the entire process of refining the composition of the steel. The bottom flows used are in accordance with the table of FIG. 7.

Sensors may be used to enhance the ability to detect and prevent nozzle clogging. In one embodiment, pressure transducers are installed at or near the tuyere exit end to detect clogging or bridging of the nozzles, which would cause a back-pressure increase. Pressure sensors may also be used to detect erosion of the nozzles and damage of the converging-diverging and/or cavity features of the nozzles, as exhibited by variations in pressure drop. In another embodiment, thermocouples may be installed at or near the tuyere exit end to detect deviation of temperatures from normal operation due to erosion of nozzles and seeping of molten metal through the nozzle.

In addition to the foregoing, a high volume (high pressure) jet may be periodically used to keep the nozzles from clogging or introduced in response to detection of deviation of pressures/temperatures from normal operation. Other corrective actions such as bottom-washing of the vessel with oxygen may be used to unclog the nozzles in a timely manner.

The present invention is not to be limited in scope by the specific aspects or embodiments disclosed in the examples which are intended as illustrations of a few aspects of the invention and any embodiments that are functionally equivalent are within the scope of this invention. Various modifications of the invention in addition to those shown and described herein will become apparent to those skilled in the art and are intended to fall within the scope of the appended claims.

The invention claimed is:

1. A method of operating a bottom stir tuyere in a basic oxygen furnace for steel making, wherein the bottom stir tuyere has a concentric nozzle arrangement with an inner nozzle surrounded by an annular nozzle, the method comprising:

(a) during a molten metal pour phase, flowing an inert gas through both nozzles of the bottom stir tuyere;

(b) during a blow phase, continuing to flow the inert gas through both nozzles of the bottom stir tuyere;

(c) during a tap phase, initiating a flow of a first reactant and ceasing the flow of inert gas through the inner nozzle of the tuyere, and initiating a flow of a second reactant and ceasing the flow of inert gas through the annular nozzle of the tuyere, wherein the first reactant includes one of fuel and oxidant and the second reactant includes the other of fuel and oxidant, such that a flame forms as the fuel and oxidant exit the tuyere;

(d) during a slag splash phase, continuing the flows of fuel and oxidant to maintain the flame; and (e) after ending the slag splash phase and commencement of another molten metal pour phase, initiating a flow of inert gas through both nozzles of the bottom stir tuyere and ceasing the flows of the first and second reactants.

2. The method of claim 1, wherein the inert gas flowed through both nozzles in step (a) comprises nitrogen, argon, carbon-dioxide, or combinations thereof.

3. The method of claim 1, wherein in steps (c) and (d), oxidant is flowed through the inner nozzle as the first reactant and fuel is flowed through the annular nozzle as the second reactant.

4. The method of claim 1, wherein the first reactant has a velocity $V_P$ and the second reactant has an axial velocity $V_S$, and wherein the ratio of the first reactant velocity to the second reactant axial velocity is $2\ V_P/V_S \leq 30$.

5. The method of claim 1, further comprising, in step (d), additionally flowing a diluent gas in conjunction with the oxidant and adjusting the relative proportion of diluent gas to oxidant, thereby adjusting an energy release profile of the burner.

6. The method of claim 5, further comprising, in step (d), additionally flowing a diluent gas in conjunction with the fuel and adjusting the relative proportion of diluent gas to fuel.

7. The method of claim 1, further comprising causing one or both of the first reactant and the inert gas to exit a central nozzle at a velocity attaining from Mach 0.8 to Mach 1.5.

8. The method of claim 1, further comprising imparting swirl to the second reactant and the inert gas exiting the annular nozzle.

9. The method of claim 1, further comprising sensing at least one of a pressure and a temperature of the tuyere to detect a deviation from normal operating conditions, and taking corrective action in response to a detected deviation from normal operating conditions, wherein the corrective action includes one or more of flowing a volume of inert gas through both nozzles of the tuyere, prescribing bottom washing of the furnace, and shutting down furnace operation.

10. A method of operating a bottom stir tuyere in a basic oxygen furnace for steel making, wherein the bottom stir tuyere has a concentric nozzle arrangement with an inner nozzle surrounded by an annular nozzle, the method comprising:

(a) during a molten metal pour phase, flowing an inert gas through both nozzles of the bottom stir tuyere;

(b) during a blow phase, continuing to flow the inert gas through both nozzles of the bottom stir tuyere;

(c) during a tap phase, initiating an electric discharge between the inner nozzle and the annular nozzle while continuing the flow of inert gas through the inner nozzle and annular nozzles, thereby causing a plasma to discharge from the tuyere;

(d) during a slag splash phase, continuing the electric discharge to maintain the plasma discharge from the tuyere; and (e) after ending the slag splash phase and commencement of another molten metal pour phase, continuing the flow of inert gas through inner and annular nozzles of the bottom stir tuyere while ceasing the electric discharge.

* * * * *